US006290899B1

(12) United States Patent
Then

(10) Patent No.: US 6,290,899 B1
(45) Date of Patent: Sep. 18, 2001

(54) CONVERTER INSTALLATION HAVING A DIVIDED SEALING RING FITTED BETWEEN THE CONVERTER AND THE FLUE GAS CHIMNEY

(75) Inventor: Peter Then, Essen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/581,931

(22) PCT Filed: Dec. 4, 1998

(86) PCT No.: PCT/DE98/03632

§ 371 Date: Jul. 12, 2000

§ 102(e) Date: Jul. 12, 2000

(87) PCT Pub. No.: WO99/32669

PCT Pub. Date: Jul. 1, 1999

(30) Foreign Application Priority Data

Dec. 19, 1997 (DE) ..... 197 58 141

(51) Int. Cl.[7] ..... C21C 5/42

(52) U.S. Cl. ..... 266/158; 266/242

(58) Field of Search ..... 266/148, 158, 266/159, 242

(56) References Cited

U.S. PATENT DOCUMENTS

| | | | | |
|---|---|---|---|---|
| 2,855,194 | * | 10/1958 | Konig | 266/158 |
| 3,205,810 | * | 9/1965 | Rosenak | 266/159 |
| 3,215,425 | * | 11/1965 | Vogt | 266/158 |
| 3,223,399 | * | 12/1965 | Walker | 266/158 |
| 3,599,949 | * | 8/1971 | Grenfell | 266/158 |

* cited by examiner

*Primary Examiner*—Scott Kastler
(74) *Attorney, Agent, or Firm*—Cohen, Pontani, Lieberman & Pavane

(57) ABSTRACT

A converter plant with a sealing ring provided between the hood of a tiltable converter and the mouth of a smoke gas flue, drives are provided, for moving the sealing ring can be moved so far away from the converter hood that the converter can be tilted without obstruction. At the same time, the sealing ring is designed as a sleeve which surrounds the smoke gas flue from outside. The mouth of the sleeve is capable, in the closing position, of leaning against the converter hood the and the sleeve has vertical severing cuts which divide the sleeve into at least two segments.

2 Claims, 3 Drawing Sheets

CONVERTER INSTALLATION HAVING A DIVIDED SEALING RING FITTED BETWEEN THE CONVERTER AND THE FLUE GAS CHIMNEY

This application is a 371 of PCT/DE 98/03632 filed on Dec. 4, 1998.

BACKGROUND OF THE INVENTION

1. Field of the Invention

The invention relates to a converter plant with a sealing ring provided between the hood of a tiltable converter and the mouth of a smoke gas flue. Drives are provided, by means of which the sealing ring can be moved so far away from the converter hood that the converter can be tilted without obstruction.

2. Discussion of Prior Art

Converters for steel production are equipped, as a rule, with a water-cooled cooling flue, in order to pick up and discharge the process gases emerging at the mouth. In this case, the converter mouth is located at a distance from the inlet orifice of the cooling flue, so that the vessel for charging and emptying can be moved past below the flue aperture.

In plants operating by the suppressed combustion of the process gases, the gap must, as far as possible, be kept completely closed during the process. Consequently, the ingress of air to the converter gas sucked away is to be limited, in order to pick up, unburnt, the combustible gas with its high thermal value and, after appropriate cooling and purification, deliver it for further utilization. For this purpose, a movable water-cooled ring is normally arranged at the flue inlet and can be lowered by means of a hydraulic or other mechanical device, in order thereby to reduce the air gap during the process.

Since the ring, because of its necessary movability, is at a structurally prescribed distance from the fixed flue inlet, an air gap remains between the two components. However, at this gap, both air can continue to enter the process gas or else hot dust-containing process gas may escape into the working spaces. Both are undesirable, however, and should certainly be prevented.

Furthermore, various additional devices for sealing off the residual gap between the ring and the cooling hood are known, such as, for example, a water lute, filming with steam or inert gas or reversals by means of a skirt which is intended to produce a kind of labyrinth seal.

These known sealing systems have disadvantages which are caused by the extreme operating conditions at the place of installation and poor accessibility. Thus, a water lute requires a large amount of space, and, furthermore, it is susceptible to faults and complicated to maintain.

Filming involves a consumption of costly operating materials.

Labyrinth-like skirts are complicated because of the cooling which is required, they are of limited effect due to the residual gaps and they also have poor accessibility.

Other disadvantages of all the sealing systems mentioned are the maintenance and cleaning of the parts due to slags and steel being caked on in the sealing region, particularly on account of poor accessibility.

J.P. Japanese reference 63-42321 discloses a smoke gas flue, in which the mouth region is arranged so as to be movable coaxially to a central flue tube. This mouth rests loosely on the converter.

SUMMARY OF THE INVENTION

In the light of the difficulties mentioned above, the object of the present invention is, by means of simple design, to close the gappy converter and flue sealingly during operation and, furthermore, to form the possibility of making a gastight connection between the flue and converter and thus operate the plant even under excess pressure.

According to the invention, the sealing ring is designed as a sleeve which surrounds the smoke gas flue from outside. At the same time, in the closing position, the mouth of the sleeve is capable of leaning against the converter hood. Such a sleeve has, in this case, vertical severing cuts so that, a closing ring is obtained, which is composed of two or more part segments movable relative to one another. The individual segments have an inner radius which is identical to the outer radius of the lower part of the flue. As soon as the part segments of the closing ring bear against the flue wall, the ring is sealingly closed.

Attached to the segments of the closing ring on the outside are devices by means of which the segment can be pushed apart from one another horizontally. As a result, the rings come loose from the cooling flue wall in the middle and can then, as desired, be lowered onto the converter mouth or moved away from the latter.

As soon as the vertical movement operation has ended and the ring is to remain in the position reached, the ring segments are drawn together again by the device, until they once again bear sealingly against the wall of the flue. When the closing ring is to be brought into a new position, the segments are first released from one another again with the aid of the device, and the ring is brought by the lifting device into the new position and closed again.

The horizontal distance between the individual segments can be set within a predetermined range. It thereby becomes possible to design the ring in such a way that it can be lowered over the edge of the converter and, when being closed, likewise surrounds the latter sealingly. Consequently, air cannot be sucked into the converter gas, nor can the converter gas escape out of the system into the working space.

Furthermore, however, any desired intermediate positions may be adopted, in which case it is always ensured that the gap between the flue and the closing ring is fully sealed off.

The ring segments may also be fastened in such a way that they are attached pivotably at the their upper edge to a holding device and are moved laterally upward in a shell-like manner into an opened position or downward into the closed position. For the pivoting movements, either suitable lifting linkages may be arranged fixedly or else movable hydraulic cylinders may be attached.

The ring segments are produced from water-cooled tubes which are welded sealingly to one another. At the same time, the tubes may be arranged either horizontally or vertically. The cooling water is led through movable connecting tubes which are connected to the distributors of the tubular segments.

The lateral displacement device is actuated by means of hydraulic cylinders or else by mechanical devices, such as a thrust drive or lifting linkage. The power required is supplied by means of appropriate flexible supply lines. The devices are designed and installed in such a way that they are sufficiently protected against heat and slag.

The ring segments may be connected via a guide ensuring a controlled synchronous movement sequence. Thus, for example, guide rails with a roller guide on the lower part of the flue and on the closing ring may ensure that the components maintain their position relative to one another during the movements.

BRIEF DESCRIPTION OF THE DRAWING

An example of the invention is presented in the accompanying drawing, in which.

DETAILED DESCRIPTION OF THE PREFERRED EMBODIMENTS

Figure 1:
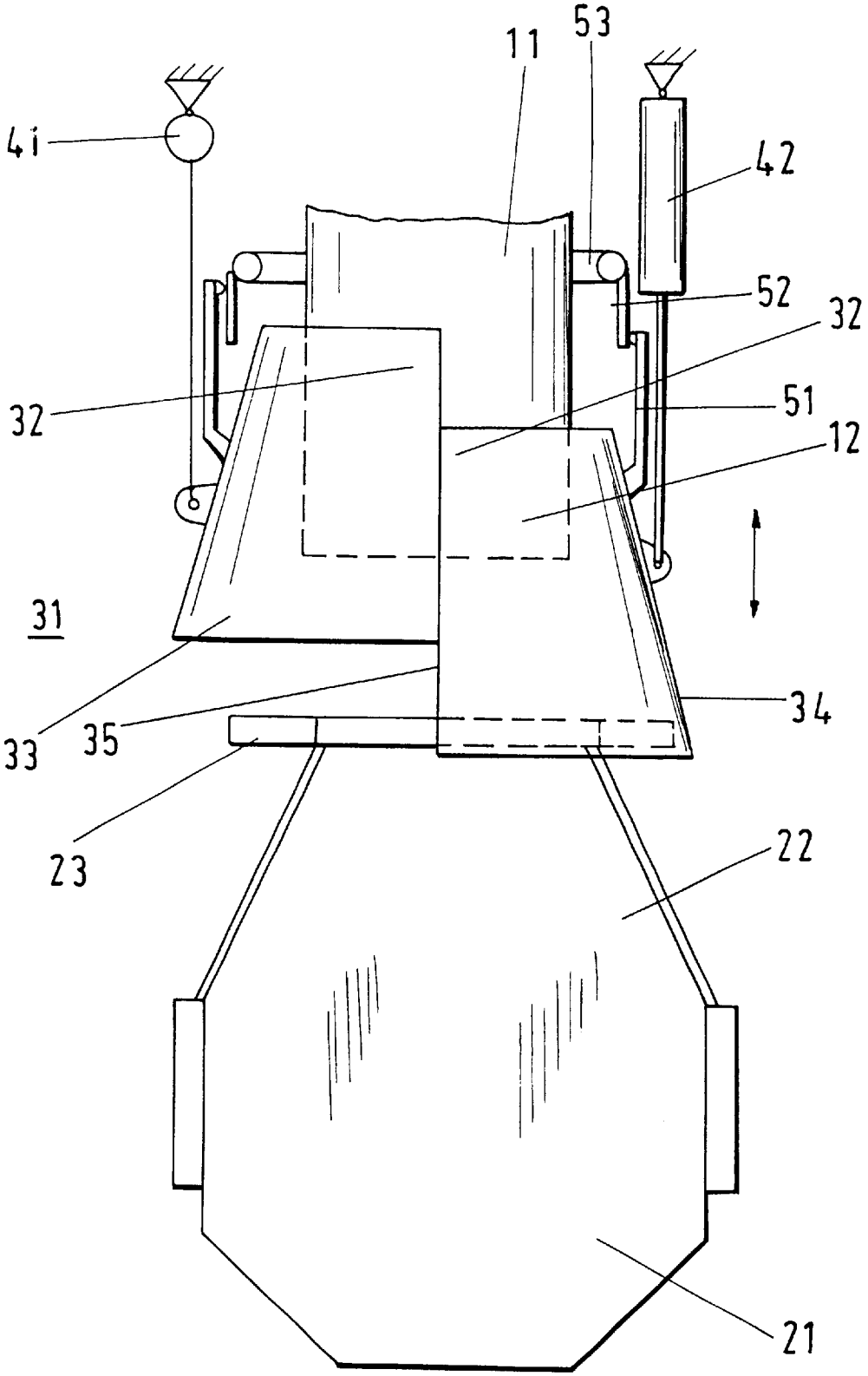
FIG. 1 shows segments of a sealing ring which are vertically movable.

The three Figures illustrate a converter 21 possessing a converter hood 22, at the mouth of which a collar 23 is provided.

Above the converter 21 is provided a smoke gas flue 11 which has a mouth 12. Arranged in the mouth region is a sealing ring 31 which possesses a sleeve 32 with sleeve segments 33 and 34. However, this sealing ring may also have a greater number of individual segments. The sleeve segments 33, 34 have vertical severing cuts 35.

In FIG. 1, the sleeve segment 33 is connected to a drive 41 and the sleeve segment 34 to a lifting device 42, by means of which the segments 33, 34 can be moved in the vertical direction. Moreover, a guide element 51 is fastened to the segments 33, 34, said guide element matching a guide bar 52 which is fastened to a spacer tube 53.

Figure 2:
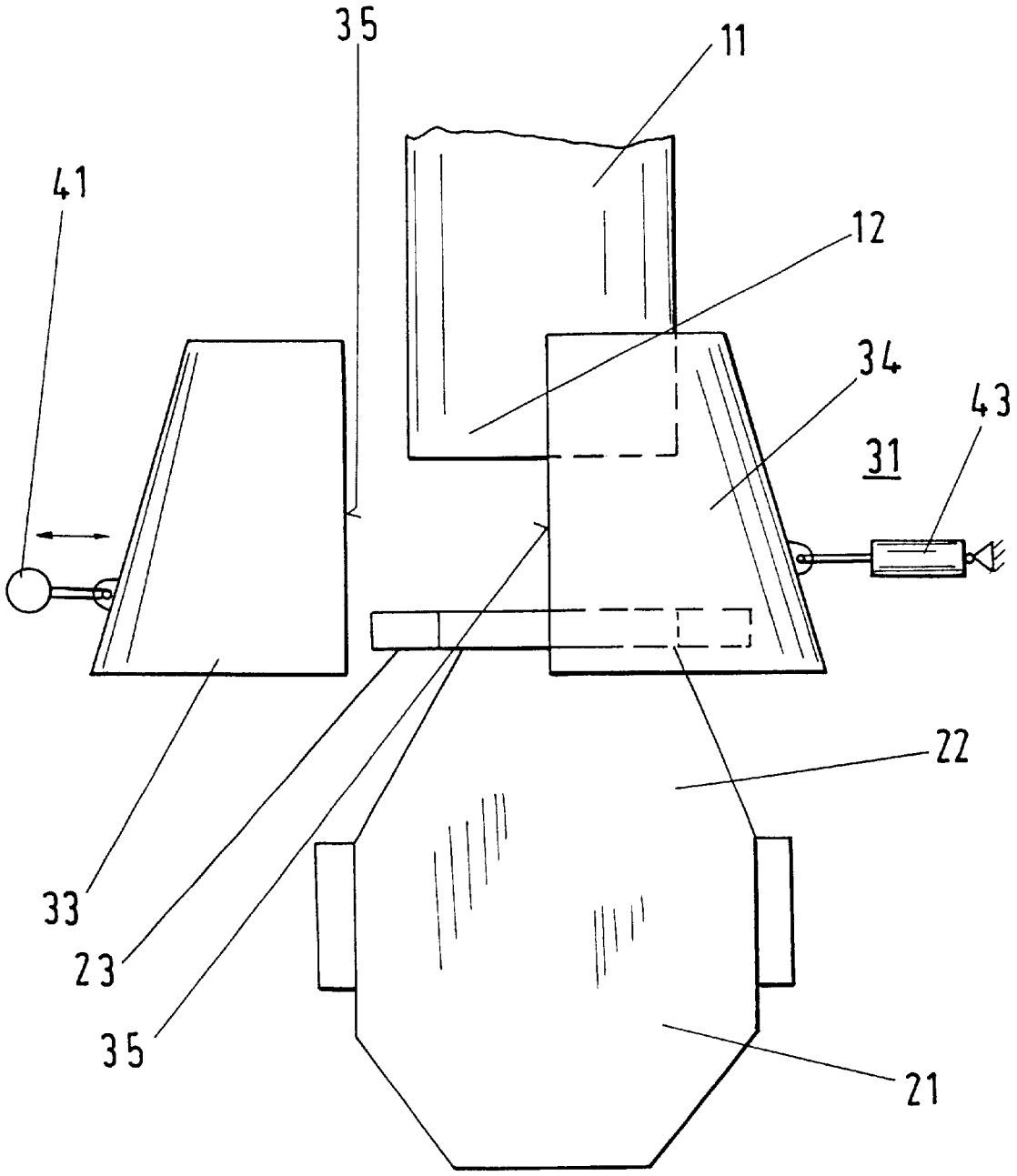
FIG. 2 show s segments of a sealing ring which are vertically and horizontally movable.

In FIG. 2, the sleeve segment 33 is connected to a drive 41 and the sleeve segment 34 to a closing arrangement 43, by means which the sleeve segments 33, 34 are horizontally movable.

Figure 3:
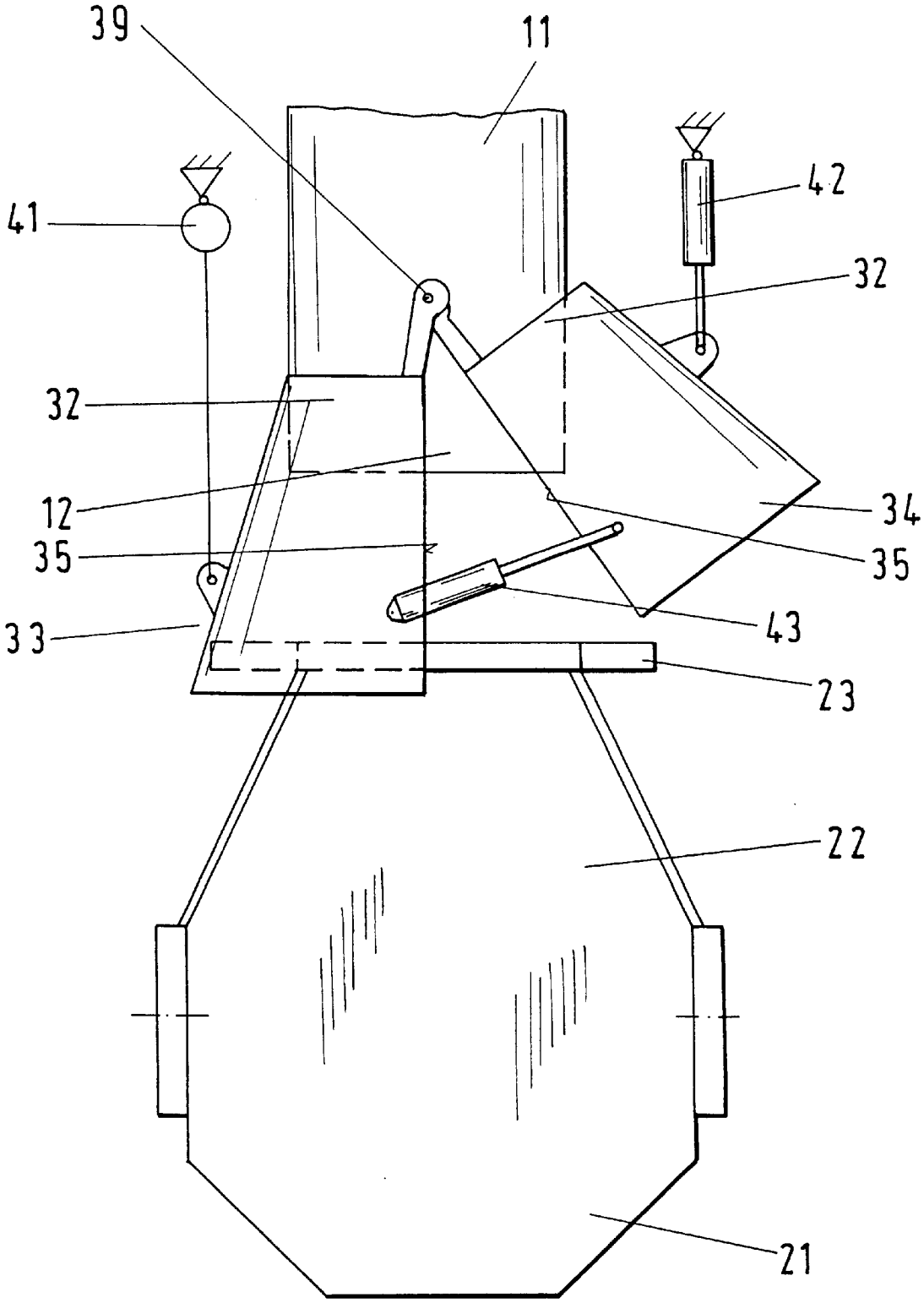
FIG. 3 shows segments of a sealing ring which are pivotable.

In FIG. 3, the sleeve segments 33 and 34 are connected to one another via a joint 39. In this case, the sleeve segment 33 is pivoted by means of a drive 41 and the sleeve segment 34 by means of a lifting arrangement 42. Futhermore, on the sleeve segments 33, 34 is provided a closing arrangement 43, by means of which the sleeve segments can be opened and can be pressed sealingly against the collar 23 of the converter hood 22.

The invention is not limited by the embodiments described above which are presented as examples only but can be modified in various ways within the scope of protection defined by the appended patent claims.

What is claimed is:

1. A converter plant, comprising: a smoke gas flue; a tiltable converter having a hood; a sealing ring provided between the hood of the tiltable converter and a mouth of the smoke gas flue; drives for moving the sealing ring between a closed position and an open position so far away from the converter hood that the converter can be tilted without obstruction, the sealing ring being designed as a sleeve which externally surrounds the smoke gas flue so that in the closed position the mouth of the sleeve leans against the converter hood, the sleeve having vertical severing cuts which divide the sleeve into at least two segments; and closing arrangements operatively attached to respectively adjacent segments so as to move the segments toward and away from one another, in each case two adjacent segments are connected at a head end by joints so that the segments swing open and shut when the closing arrangements are actuated.

2. a converter plant as defined in claim 1, and further comprising a guide element provided on each segment, said guide element matching a guide bar which is fastened to a spacer tube engaging annularly around the smoke gas flue.

* * * * *